United States Patent [19]

Halterman, Jr.

[11] 4,241,794

[45] Dec. 30, 1980

[54] ANGLE DOZER ASSEMBLY

[75] Inventor: Francis J. Halterman, Jr., Hiram, Ohio

[73] Assignee: General Motors Corporation, Detroit, Mich.

[21] Appl. No.: 66,070

[22] Filed: Aug. 13, 1979

[51] Int. Cl.[3] ..... E02F 3/76

[52] U.S. Cl. ..... 172/804; 172/805; 403/104; 403/377

[58] Field of Search ..... 172/804, 805, 806–809, 172/801–803, 466; 403/104, 377

[56] References Cited

U.S. PATENT DOCUMENTS

| | | | |
|---|---|---|---|
| 3,177,976 | 4/1965 | Wenzel | 403/104 |
| 3,656,559 | 4/1972 | Lennea | 172/805 |
| 3,662,838 | 5/1972 | Polzin | 172/804 |

OTHER PUBLICATIONS

International Appl. No. PCT/US78/00173, Caterpillar Tractor Co., 6/1979.

*Primary Examiner*—Richard J. Johnson
*Attorney, Agent, or Firm*—Edward J. Biskup

[57] ABSTRACT

An angle dozer assembly including a C-frame supported by a tractor. A pair of thrust members extend rearwardly from a moldboard and each terminates with a carriage which is slidable along the C-frame and adapted to be maintained in different positions by a locking fork arrangement.

2 Claims, 6 Drawing Figures

ANGLE DOZER ASSEMBLY

The invention concerns an angle dozer assembly and more particularly a support arrangement for providing adjustable positioning of a moldboard.

Angle bulldozers generally include a C-frame pivotally connected to a tractor for powered movement about a transverse horizontal axis. A moldboard is supported at the front end of the C-frame with the outer ends of the moldboard connected to the side arms of the C-frame by hinged thrust members which support tilt struts. The rear end of each thrust member is adapted to be locked in several positions along the length of the C-frame side arms to permit the moldboard to be located in a straight-across position and angled positions, and one form of carriage that has heretofore been used for connecting the rear of each thrust member to the C-frame and permitting sliding movement therealong when the moldboard is being adjusted in position is disclosed in Polzin et al. U.S. Pat. No. 3,662,838. As seen in the latter mentioned patent, the carriage comprises a U-shaped base member supported by the side arm of the C-frame for movement along elongated guide rails. A ball stud projects laterally outwardly from the base member and serves as one part of a universal joint which connects the carriage with the thrust member. At least three axially spaced apertures extend through the guide rail and the C-frame and serve to accommodate a manually removable cylindrical pin adapted to extend through the base member into the apertures so as to lock the carriage in place on the C-frame. The three apertures constitute stations for locating the blade in the angled-left position, the straight-across position, and the angled-right position.

The present invention is directed towards an angle dozer assembly provided with a carriage of the type described above but rather than having a cylindrical pin for locking the carriage in place, the carriage is combined with U-shaped keeper members which are adapted to straddle the side arm of the C-frame and maintain the carriage in a fixed position. The advantages of an angle dozer assembly made according to the present invention is that the keeper member is readily accessible for quick removal and can be installed without requiring exact alignment as is the case with the cylindrical pin heretofore used.

The objects of the present invention are to provide an angle dozer assembly having thrust members that are adjustably carried by a C-frame and are adapted to be locked thereto through a manually removable U-shaped keeper member; to provide a carriage which serves to connect the thrust members of an angle dozer assembly to the C-frame and is slidable along guide rails to predetermined positions during angling adjustment of the moldboard; to provide a carriage which forms a part of an angle dozer assembly and permits rapid adjustment of the moldboard by cooperating with stop members which define the angled-left position, straight-across position, and angled-right position of the moldboard; and to provide an angle bulldozer which incorporates a slidable carriage for supporting the rear end of the thrust member and has a manually removable locking fork which is normally retained in position during a dozing operation by a pin extending through the tines of the fork.

Other objects and advantages of the present invention will be more apparent from the following detailed description when taken with the drawings in which.

Figure 1:
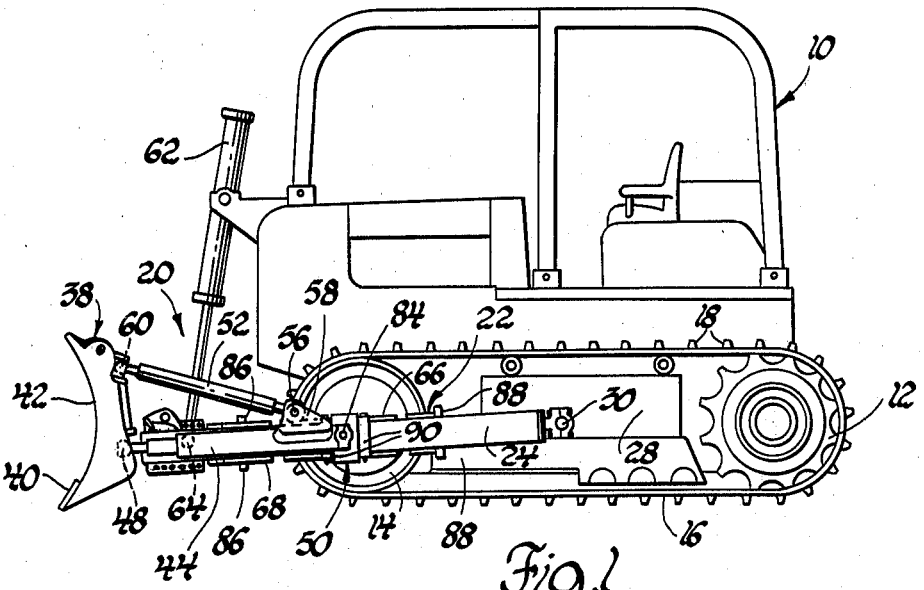
FIG. 1 is an elevational view showing a crawler tractor incorporating an angle dozer assembly made in accordance with the invention.
Figure 2:
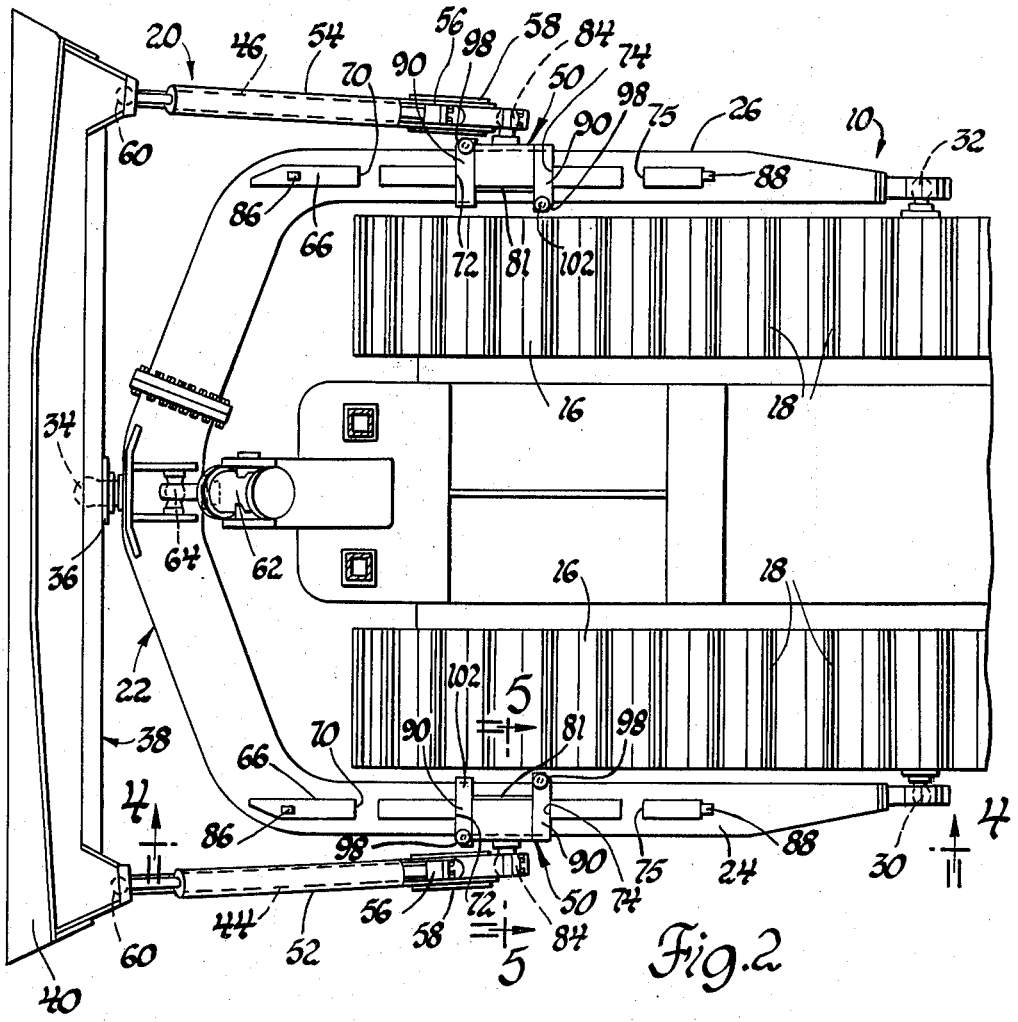
FIG. 2 is an enlarged fragmentary plan view showing the crawler tractor and the angle dozer assembly of FIG. 1.

Referring to the drawings and more particularly FIGS. 1 and 2 thereof, a crawler tractor 10 is shown having the usual drive sprocket 12 and idler wheel 14 located on each side of the tractor. An endless track 16 is entrained about the drive sprocket 12 and the idler wheel 14 and is provided with a plurality of equally spaced ground-engaging grousers 18. The forward end of the tractor 10 is equipped with an angle dozer assembly 20 made in accordance with the invention and which includes a C-frame 22 having laterally spaced generally parallel side arms 24 and 26 located outboard of each endless track 16 and connected at the rear ends thereof to the tractor roller frames 28 by spherical connections 30 and 32. The forward end of the C-frame 22 rigidly carries a ball stud 34 which is retained within a socket device 36 located in the rear of a transverse moldboard 38 adjacent the lower portion thereof. The moldboard 38 is supported by the ball stud 34 for universal movement and is of the conventional type having a transverse cutting blade 40 located at the forward lower end and a curved outer surface 42 causing cut material to flow forwardly during a dozing operation.

The outer ends of the moldboard 38 are connected to the side arms 24 and 26 of the C-frame 22 by thrust members 44 and 46, each of which has the forward end thereof provided with a ball stud 48 located within a suitable bearing pocket formed in the moldboard 38. The rear end of each thrust member 44 and 46 is connected to the C-frame 22 through a carriage 50, shown in detail in FIG. 5 and which will be described more fully hereinafter. The thrust members 44 and 46 serve as supports for screw-type jacks 52 and 54, each of which has its rear end connected by a ball joint 56 to a support bracket 58 fixed to the thrust member. The front end of each jack 52 and 54 is also connected by a ball joint 60 to the upper rear corner of the moldboard 38. It will also be noted that a vertically orientated hydraulic lift cylinder 62 is provided between the front upper portion of the tractor 10 and a pivotal joint 64 on the C-frame 22 and is combined with a suitable hydraulic system (not shown) permitting pressurized fluid to be directed to the lower end of the lift cylinder 62 for raising the entire angle dozer assembly 20 about a transverse horizontal axis passing through the spherical connections 30 and 32.

Figure 3:
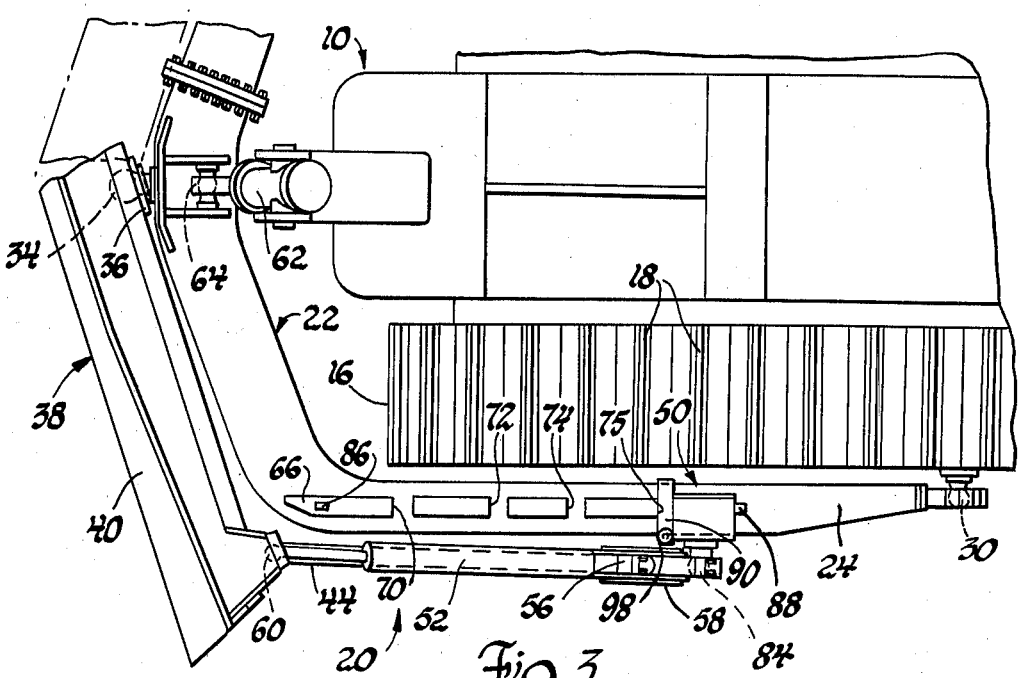
FIG. 3 is a view similar to FIG. 2 but shows the moldboard of the angle dozer assembly located in an angled position.

The angle dozer assembly 20 described above permits the moldboard 38 to be tilted at either end by appropriate adjustment of the length of jacks 52 and 54. In addition, as seen in FIG. 3, the moldboard 38 can be angled about a vertical axis passing through the ball stud 34 to an angled-left position as shown in full lines or to an angled-right position, in which case the moldboard 38 would assume the position shown in phantom lines. Both of the angled positions are realized through the support arrangement provided by the carriage 50 which serves to connect each of the thrust members 44 and 46 to the C-frame 22.

Figure 5:
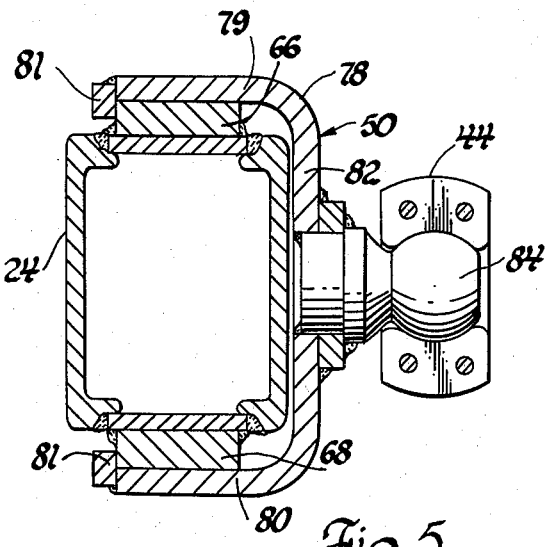
FIG. 5 is an enlarged sectional view taken on line 5—5 of FIG. 2 and shows the carriage which is slidable along the C-frame.

In this regard and with reference to FIGS. 1, 2 and 5, it will be noted that each of the side arms 24 and 26 of the C-frame 22 takes the form of a box section, the upper surface of which rigidly supports an elongated guide rail 66 formed from four aligned sections extending along the longitudinal axis of the arm. The lower surface of each side arm 24 and 26 supports a similar guide rail 68 formed from four aligned sections which, as in the case with the aligned sections of the guide rail 66, define four vertically aligned slots 70, 72, 74 and 75. Each of the slots 70, 72, 74 and 75 can serve as a locating station permitting the carriage 50 on each side arm 24 and 26 to assume an angled-left position, a straight-across position and an angled-right position in a manner to be described.

Figure 4:
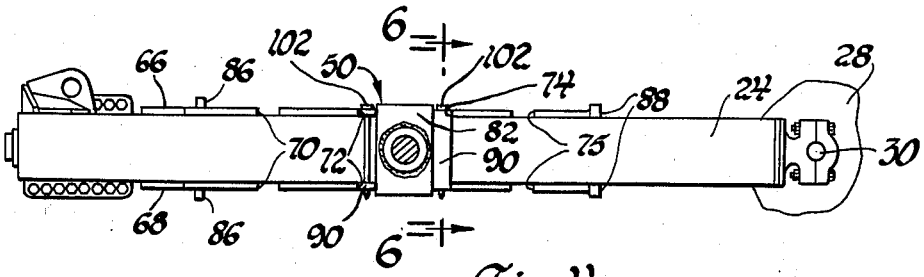
FIG. 4 is an enlarged side elevational view taken on line 4—4 of FIG. 2 and shows one arm of the C-frame employed with the angle dozer assembly.

As best seen in FIGS. 4 and 5, the carriage 50 is slidable along the associated side arm and comprises a U-shaped base member 78 having generally parallel and vertically spaced legs 79 and 80. Each of the legs 79 and 80 terminates with a bar 81 that extends inwardly for retaining the base member 78 on the guide rails 66 and 68. A vertically orientated base section 82 rigidly carries a ball stud 84 that forms one part of a spherical connection provided at the rear end of each thrust member.

Thus from the above description, it should be apparent that the carriage 50 permits the rear end of each thrust member 44 and 46 to slide along the length of the guide rails of the associated side arm of the C-frame 22. In other words, the guide rails serve as tracks along which the carriage 50 is movable. Moreover, it will be noted that, in order to properly position the carriage 50 at the angled-right or angled-left stations along the C-frame, stop members 86 and 88 are provided at the opposite ends of each of the guide rails. In addition, the straight-across position can be realized by utilizing one of a pair of identical U-shaped keeper members 90 and the vertically aligned slots 72 or 74 associated with side arm 24 or 26 as will be explained hereinafter.

Figure 6:
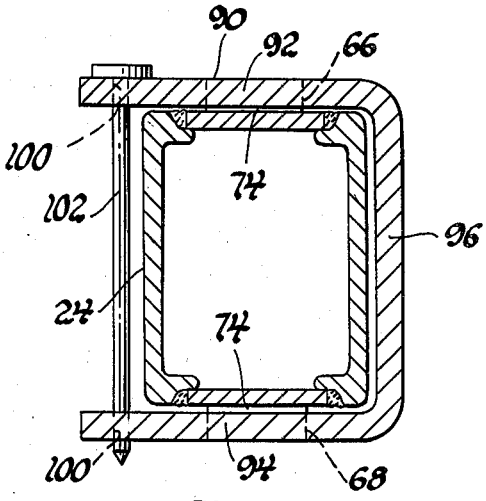
FIG. 6 is an enlarged view taken on line 6—6 of FIG. 4 and shows one of the keeper members for maintaining the carriage in a fixed position on the C-frame.

As seen in FIGS. 1–4, each side arm 24 and 26 has two identical keeper members 90 mounted thereon and, as seen in FIG. 6, each keeper member 90 takes the form of a fork formed with vertically spaced and horizontal tines 92 and 94 interconnected by a vertical base section 96. The terminal end of each tine 92 and 94 is formed with a beveled surface 98 and an aperture 100. The apertures 100 in the tines 92 and 94 are vertically aligned and serve to receive a lock pin 102 for retaining the keeper member 90 on the associated side arm. It will be noted that each of the keeper members 90 is adapted to be inserted into vertically aligned pairs of the slots 70, 72, 74 and 75 in the guide rails 66 and 68 for maintaining the carriage in a fixed position on the associated side arm while the beveled surface 98 on each tine of the keeper member 90 facilitates the insertion into the slots in the event the carriage is not perfectly oriented relative to the slots.

The operation of the invention is as follows:

Assuming the moldboard 38 is located in the straight-across position shown in FIG. 2 and it is desired to move the moldboard 38 to the angled-left position of FIG. 3, the operator will first remove the pin 102 from each of the keeper members 90 after which the keeper members will be pulled outwardly from the accommodating slots 72 and 74. Thereafter, the operator can position the left end of the moldboard 38 (lower end as seen in FIG. 2) against a tree or large boulder and drive the tractor 10 forward slowly. During such time, the carriage 50 on side arm 24 will move rearwardly while the other carriage 50 on side arm 26 will move forwardly along the guide rails 66 and 68 until the carriages engage the stop members 86 and 88. At such time, the carriages 50 will be properly positioned relative to the slots 70 and 75 of the side arms 26 and 24, respectively, and the operator can insert one keeper member 90 into the vertically aligned slots 75 in side arm 24 and another keeper member 90 into the vertically aligned slots 70 inside arm 26. This is followed by a replacement of the pins 102 into the aligned apertures 100 so as to lock the keeper members in position whereupon the bulldozer can be used for the particular operation for which the moldboard 38 has been angled. It will be noted that in this position of the moldboard 38, each carriage 50 is held in position between a stop member and one keeper member.

It should be apparent that movement of the moldboard 38 to the angled-right position (shown in phantom lines in FIG. 3) would be accomplished following the preliminary steps mentioned above and having the right end of the moldboard 38 (upper end as seen in FIG. 2) set against an immovable object as the tractor 10 is driven forward slowly. When the carriage 50 on side arm 24 contacts stop member 86 and carriage 50 on side arm 26 contacts stop member 88, the operator will then proceed to insert the keeper members 90 into the slots 70 and 75 to lock the carriages in place.

When the moldboard 38 is to reassume its straight-across position from the angled-right position, the operator will initially remove the keeper members 90 from the side arms and insert one of the keeper members 90 into slots 72 and the other keeper member 90 into slots 74 in side arms 26 and 24, respectively, and cause the left end of the moldboard to be rotated clockwise about the ball stud 34 as viewed in FIG. 3.

The carriages will engage the keeper members 90 in the slots 72 and 74 of side arms 26 and 24, respectively, to properly position the carriages. Thereafter, a keeper member 90 will be inserted into the slots 72 in side arm 24 and a keeper member 90 will be inserted in slots 74 in side arm 26 so that each carriage is held in position between two keeper members as seen in FIG. 2. A pin 102 will then be placed in the apertures 100 in each of the keeper members 90. Obviously, the keeper members 90 would be placed in the reverse slots in each of the side arms 24 and 26 if the moldboard were being moved from an angled-left position to the straight-across position.

Various changes and modifications can be made in this construction without departing from the spirit of the invention. Such changes and modifications are contemplated by the inventor and he does not wish to be limited except by the scope of the appended claims.

The embodiments of the invention in which an exclusive property or privilege is claimed are defined as follows:

1. An angle dozer assembly for a tractor including a C-frame having a pair of laterally spaced arms located on opposite sides of the tractor, each of said arms having a pair of elongated guide tracks located along the longitudinal axis of said arm and formed on opposed surfaces thereof, a moldboard having the rear portion thereof connected to a forward central point of said C-frame for adjustable movement about a vertical axis, a thrust member extending rearwardly from each lower corner of the moldboard, a carriage mounted on each arm for connecting the rear of each thrust member to the C-frame, said carriage comprising a base member carried by the associated arm for movement along said guide tracks, each of said arms having at least three axially spaced and transversely extending slots formed on each of said opposed surfaces and serving as stations for locating the moldboard in an angled-left position, a straight-across position and an angled-right position, a manually removable U-shaped keeper member having a pair of parallel tines interconnected by a base section, said keeper member being carried by each of said arms and adapted to straddle the associated arm with the tine thereof being located in a pair of aligned slots on said opposed surfaces for maintaining the base member in one of said positions on the C-frame, and locking means for preventing the keeper member from slipping out of the accommodating slots during a dozing operation.

2. An angle dozer assembly for a tractor including a C-frame having a pair of laterally spaced arms located on opposite sides of the tractor, each of said arms having a pair of elongated guide tracks located along the longitudinal axis of said arm and formed on opposed surfaces thereof, a moldboard having the rear portion thereof connected to a forward central point of said C-frame for adjustable movement about a vertical axis, a thrust member extending rearwardly from each lower corner of the moldboard, a carriage mounted on each arm for connecting the rear of each thrust member to the C-frame, said carriage comprising a base member carried by the associated arm for movement along said guide track, each of said arms having at least three axially spaced and transversely extending slots formed on each of said opposed surfaces and serving as stations for locating the moldboard in an angled-left position, a straight-across position and an angled-right position, a manually removable U-shaped keeper member having a pair of parallel tines interconnected by a base section, said keeper member being carried by each of said arms and adapted to straddle the associated arm with the tines thereof being located in a pair of aligned slots on said opposed surfaces for maintaining the base member in one of said positions on the C-frame, each of the tines of said U-shaped keeper member having an aperture formed therein, and a lock pin adapted to extend through the apertures in the legs of the U-shaped keeper member for preventing the latter from slipping out of the accommodating slots during a dozing operation.

* * * * *